US008489012B2

(12) United States Patent
Land

(10) Patent No.: US 8,489,012 B2
(45) Date of Patent: Jul. 16, 2013

(54) PAPER HANDLER

(75) Inventor: Ken Land, Sugar Land, TX (US)

(73) Assignee: Neuralog, LP, Stafford, TX (US)

( * ) Notice: Subject to any disclaimer, the term of this patent is extended or adjusted under 35 U.S.C. 154(b) by 1187 days.

(21) Appl. No.: 12/316,934

(22) Filed: Dec. 18, 2008

(65) Prior Publication Data

US 2009/0173764 A1 Jul. 9, 2009

Related U.S. Application Data

(60) Provisional application No. 61/019,461, filed on Jan. 7, 2008.

(51) Int. Cl.
*G03G 15/00* (2006.01)
*B65H 7/14* (2006.01)

(52) U.S. Cl.
USPC ..... 399/384; 399/395; 271/228; 83/367

(58) Field of Classification Search
USPC ..... 83/367, 360, 370, 371, 73–76.8; 399/367, 399/372, 375, 384, 395; 271/225–229
See application file for complete search history.

(56) References Cited

U.S. PATENT DOCUMENTS

| | | | | |
|---|---|---|---|---|
| 4,919,318 | A * | 4/1990 | Wong | 226/17 |
| 5,295,616 | A * | 3/1994 | Saeki et al. | 226/110 |
| 5,322,273 | A * | 6/1994 | Rapkin et al. | 271/227 |
| 5,555,084 | A * | 9/1996 | Vetromile et al. | 399/16 |
| 5,774,777 | A * | 6/1998 | Ohtsuka et al. | 399/384 |
| 5,905,520 | A | 5/1999 | Fujii et al. | |
| 5,954,914 | A * | 9/1999 | Aihara | 156/361 |
| 6,601,951 | B2 * | 8/2003 | Kuwabara et al. | 347/101 |
| 7,472,905 | B2 * | 1/2009 | Inoue | 271/227 |
| 7,500,669 | B2 * | 3/2009 | Mandel | 271/227 |
| 7,607,660 | B2 * | 10/2009 | Inoue | 271/228 |
| 2002/0166467 | A1 * | 11/2002 | Codos et al. | 101/35 |
| 2004/0119226 | A1 * | 6/2004 | Christensen et al. | 271/227 |
| 2005/0214049 | A1 * | 9/2005 | Morita | 399/394 |
| 2011/0135362 | A1 * | 6/2011 | Cho | 399/372 |

* cited by examiner

*Primary Examiner* — Laura M. Lee
(74) *Attorney, Agent, or Firm* — D'Ambrosio & Menon, PLLC

(57) ABSTRACT

An automated paper handling system for sending print media through a printer comprising a scan module for scanning print media and producing raw data regarding characteristics of the print media. The paper handling system also has a controller comprising a memory and a processor for receiving and processing the raw data to produce an information set. One or more connection ports connect the controller to a group of equipment, the group may comprise a printer, a paper detector, a cutting system, or an alignment system.

12 Claims, 5 Drawing Sheets

PAPER HANDLER

CROSS-REFERENCE TO RELATED APPLICATIONS

This application relates to Provisional Application U.S. Ser. No. 61/019,461 filed 7 Jan. 2008 all of which are entirely incorporated herein by reference.

FIELD OF THE INVENTION

Embodiments described herein generally relate to an apparatus and method for handling print media during a printing process. More particularly, the embodiments described herein relate to a method and apparatus for detecting a condition of the print media and adjusting the handling of the print media during the printing operation based on the condition.

BACKGROUND OF THE INVENTION

During printing operations paper is fed into the printer and travels through the printer on a preselected path. The preselected path is typically one in which two of the edges of the paper are substantially in line with the travel direction of the paper and two of the edges of the paper are substantially normal to the travel direction of the paper. It is common for the paper to move out of alignment while traveling through the paper handler and the printer. When the paper moves out of alignment it often has adverse effects on the printer and/or the paper. For example, the printer can jam, the paper can become wrinkled and/or the paper can become torn. The problems related to paper moving out of alignment are magnified when the paper is longer than a typical single sheet of paper for example in a continuous feed paper, fanfold paper, or paper on a roller. When the printer becomes jammed or the paper is damaged, valuable man hours and information can be lost as a result.

When printing on a paper having a preexisting design such as a page of labels it is often difficult to align the printed text with the proper location on the labels. The operator typically types the text to be printed on the label in a word processing program, then prints them on a sheet of labels to test the location. If the printed text is in line with the labels, the operator prints more labels. If the printed text is out of alignment with the labels, the operator must adjust the location of the text on the word processor and try again. This process can take several iterations and waste several sheets of labels before the location of the printed text is in the proper location on the labels.

Therefore, there is a need for making adjustments to the alignment of the paper during the printing operation.

SUMMARY OF THE INVENTION

Embodiments described herein relate to a paper handler and a method of handling paper within a printing system. In one embodiment, an automated paper handling system senses the alignment of print media (print media and paper are used interchangeably for paper, labels and other media typically sent through a printer using a paper handling system) as it is fed through the printing system and makes adjustments to the alignment of the print media during the printing operation. In another embodiment, the paper handling system is capable of detecting characteristics of the print media and adjusting a portion of a printing operation based on one or more of the characteristics. The printing system may comprise a scan module for scanning a media and producing an information set about print media. The printing system may further comprise a controller having a memory and a processor for processing the information set. The printing system may further comprise one or more connections ports connecting the controller to a group of equipment, the group comprising the printer, a paper detector, a cutting system an alignment system or combinations thereof.

Embodiments described herein relate to a method of printing on a print media. In one embodiment, the method comprises scanning print media and producing an information set containing information about print media. The method further comprises sending the information set to a controller and processing the information set in the controller. The method further comprises controlling a characteristic of print media based on the processed information set.

DETAILED DESCRIPTION

Figure 1:
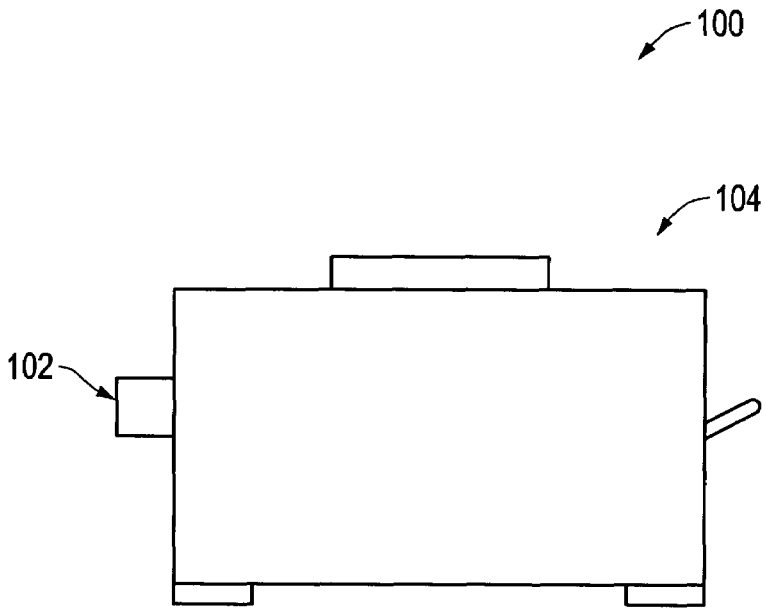
FIG. 1 is a side view of a printing system.

FIG. 1 is a side view of a printing system 100 according to one embodiment. The printing system 100 has a paper handler 102 attached to a printer 104. The paper handler 102 is adapted to feed a print media into the printer 104 while controlling one or more characteristics of the print media. The print media is selected from one or more pages of labels 600, one or more individual sheets of paper 500 or one or more pages of fan fold paper 502. The paper handler 102 can control the alignment of the print media, the start point of a print job, the time a print job starts, a location on the print media for printing, an end point of the print job, and/or a cutting location. The printer 104 can be any printer capable of printing onto print media. The paper handler 102 can be adapted to attach to any brand or type of printer 104. The paper handler 102 can be easily attached and removed from the printer 104. This allows an operator to attach the paper handler 102 to any printer 104 in order to control the print media during a print job. Further, maintenance of the paper handler 102 does not require work to be performed on the printer 104. Therefore, the paper handler 102 can be quickly and easily replaced in order to perform maintenance on the paper handler 102 with minimum interruption to the printing operation.

Figure 2:
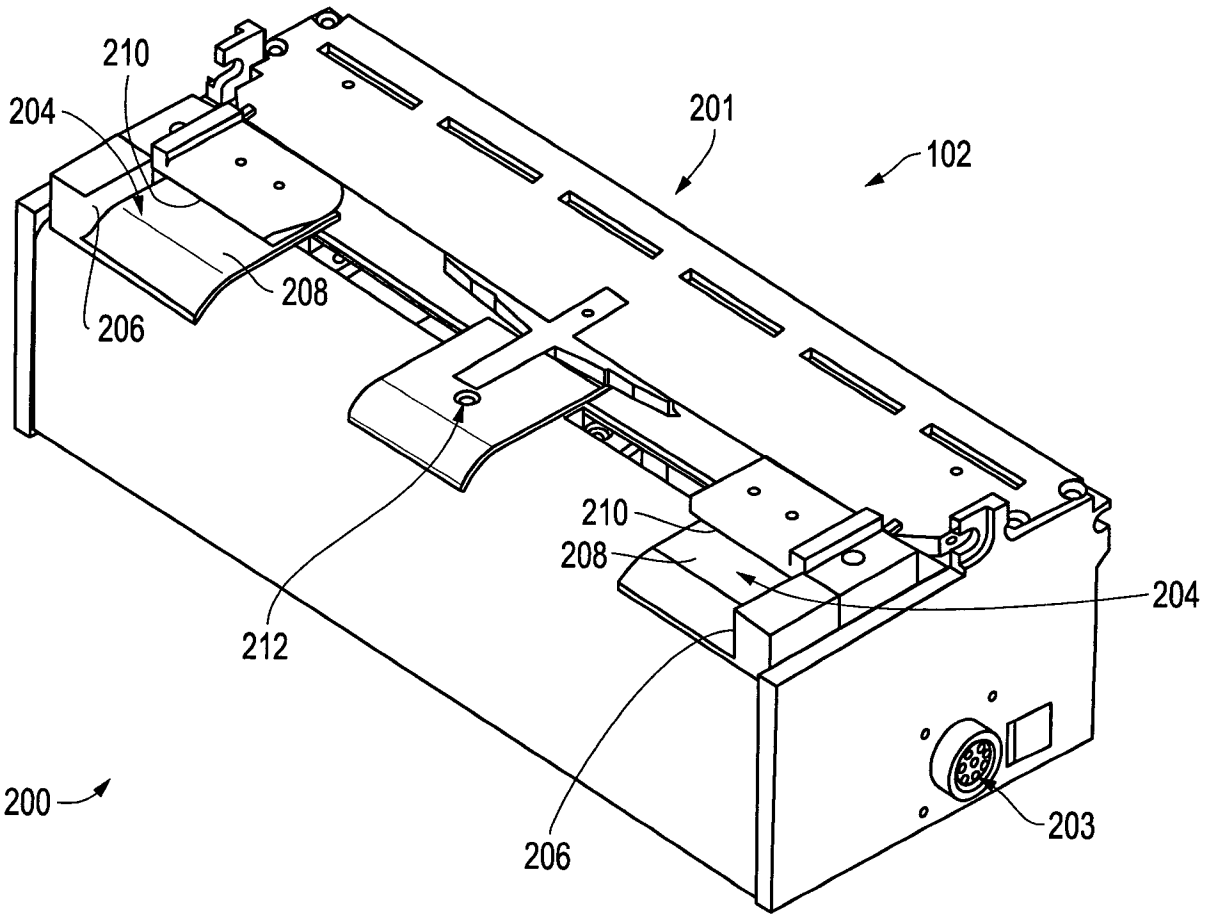
FIG. 2 is a schematic perspective view of a paper handler.

FIG. 2 is a perspective view of the paper handler 102, according to one embodiment. The paper handler 102 has a paper inlet 200 and a paper exit 202. The paper inlet 200 receives print media 300, shown in FIG. 3, as print media 300 is fed into the printing system 100. The paper exit 202 is adapted to discharge print media 300 from the paper handler 102 to a printer inlet (not shown). The paper handler 102 can further have one or more connection ports 203. The connection ports 203 allow the paper handler 102 to send and receive information, data, and/or power. In one embodiment, one or more connection ports connect the controller to a group of equipment, the group comprising the printer, a paper detector, a cutting system, an alignment system or combinations thereof The paper inlet 200 of the paper handler 102 has one or more guide members 204 for guiding print media 300 into the paper handler 102. As shown in FIG. 2, each of the guide members 204 has a guide edge 206, a bottom surface 208 and a top surface 210. The guide edges 206 can engage an edge of print media 300 that is fed into the paper handler 102, thereby substantially maintaining print media 300 between the two guide members 204 as print media 300 travels through the paper inlet 200. The bottom surface 208 and the top surface 210 of the guide members 204 guide print media 300 toward the proper location within the paper handler 102 during operation. The guide members 204 can be manually adjusted to match the width or length of print media 300 or can be automatically adjustable, as will be described in more detail below. The paper inlet 200 can have an optional paper detector 212. The paper detector 212 can detect the presence of print media 300 in the paper handler 102 and will be described in more detail below.

The paper exit 202 side of the paper handler 102 can have a connection member (not shown) for coupling the paper handler 102 to the printer 104. The connection member will vary in design based on the type of printer the paper handler 102 is designed to engage. Further, the connection member will be a distance from the paper exit 202 which allows the paper exit 202 to align with the printer inlet. This allows print media 300 to flow seamlessly into the printer 104 from the paper handler 102.

Figure 3:
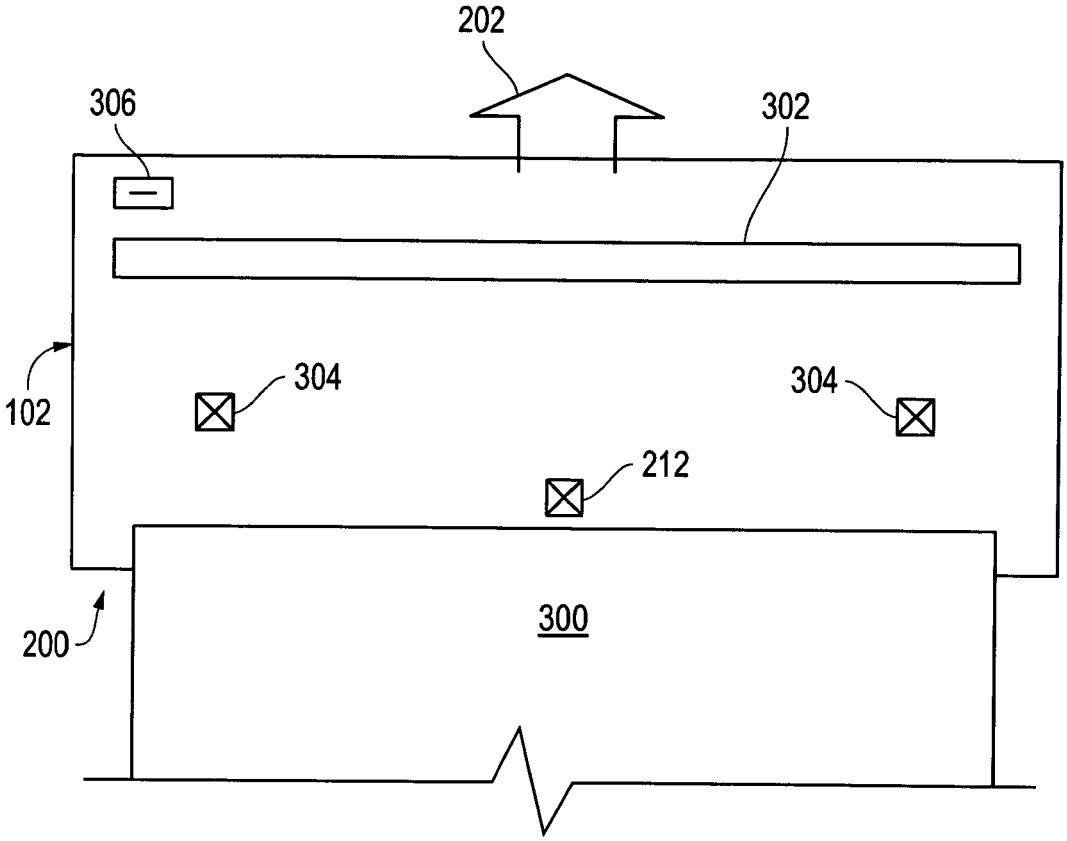
FIG. 3 is a schematic top view of a paper handler.

FIG. 3 is a schematic top view of the paper handler 102 without a top cover. As shown, the paper handler 102 has a scan module 302, two or more motive members 304, electric motors for example, the paper detector 212 and a cutting system 306. The scan module 302 can be adapted to scan print media 300 as print media 300 is fed through the paper handler 102. The scan module 300 produces data regarding the characteristics of the print media 300 which is sent to a controller 400, shown in FIG. 4. Characteristics of the print media 300 scanned by the scan module include but are not limited to edges of the print media, top or bottom of the print media, alignment, feed angles of the print media, folds or perforations in the print media, speed at which the media is traveling, the width and length of paper, the dimensions and count of individual pages, the positions, dimensions and count of labels, the analysis of any preprinted marks or grids on the paper, the count of print jobs that have traveled through the system. The controller 400 processes the data to produce an information set. In one embodiment, the length of the scan module 302, as shown, may be greater than the width and/or length X of print media 300 fed across the scan module 302.

Figure 4:
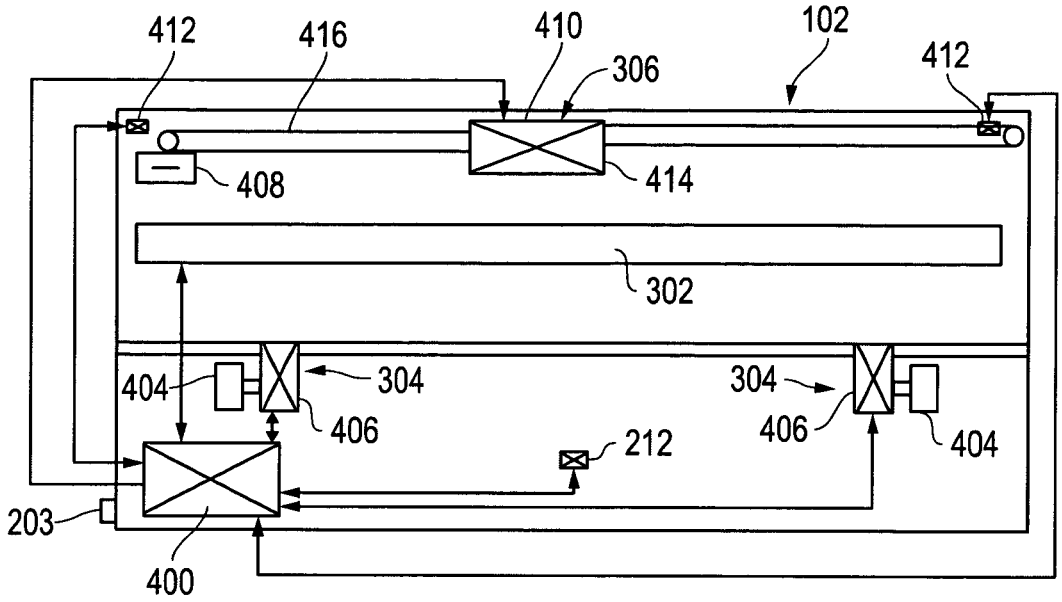
FIG. 4 is a schematic view of a paper handler.

Referring to FIGS. 3 and 4, as the scan module travels across the width of the print media 300, the length of the scan module 302 allows the information set to include information about the entire print media 300 rather than just a portion of it. In an alternative embodiment, not shown, the length of the scan module 302 may be greater than the width of the print media 300 and the scan module travels down the length of the print media 300. The scan module can comprises one or more light sources and one or more lenses for receiving a reflected light from the print media. In one aspect of the invention, the light source has a length which spans the width of the print media as it travels across the print media. Alternatively, the light source has a width that spans the width of the print media as it travels down the print media.

Although shown as the scan module 302 being one item spanning across the entire print media 300, it should be appreciated that the scan module 302 could span across one or more portions of print media, or be a series of multiple scan modules located at various locations on print media 300 so long as the scan module 302 can detect enough of the print media to determine the feed angle of print media 300.

In one embodiment, the scan module 302 is any device that detects and analyzes characteristics of the print media including images or tags on the media and converts it to a digital image. The scan module 302 can be an optical flatbed scanner in one embodiment. The optical flatbed scanner can gather light from light emitting diodes (LED) and direct the light at print media 300 being scanned. The light reflected from print media can be gathered by one or more lenses and then directed to an image sensor that rests under print media 300. The sensor then records the images according to the intensity of light that hits the sensor. Although the scan module 302 is described as being an optical flatbed scanner, it should be appreciated that any scanner or combination of scanners suitable for scanning print media 300 can be used including, but not limited to, a compact image sensor (CIS), a charge coupled device (CCD), a rotary scanner, a drum scanner, a planetary scanner, a 3D scanner, a digital camera scanner. Further, although the scan module 302 is described as using optics, it should be appreciated that any suitable type of waveforms can be used including, but not limited to, visible optics, infrared, ultraviolet light, electromagnetic wave, X-rays, microwaves, radio waves and/or other forms of electromagnetic radiation.

The scan module 302 produces the data regarding information about print media 300 that is fed past the scan module 302. The data is then sent to the controller 400 which creates an information set about the print media. Due to the nature of the scan module the data can contain information regarding the entire media 300 fed through the paper handler 102 or parts of it. For example, the information set produced by the controller 400 can include, but is not limited to, any combination of information regarding the width of print media 300, the length of print media 300, the angle print media 300 is traveling relative to a preselected path, the distance locations on print media 300 are away from the scan module 302, the presence of shadows on print media 300, the location of images printed on print media 300, the location of images formed in print media 300, the shape of anything on or in print media 300, the color of anything on or in print media 300, the location(s) of edges of print media 300, the location and/or direction of any folds in print media 300 and/or the location of perforations in print media 300. The information set can be continuously or intermediately sent to the controller 400 while print media 300 is fed through the printing system 100.

FIG. 4 shows a schematic drawing of the paper handler 102 with the controller 400 in communication with various components of the paper handler 102. The controller 400 can be in wired or wireless communication with the various components of the paper handler 102 and/or the printer 104. The controller 400 can be internal to the paper handler 102 or an external item. The controller 400 can include a programmable central processing unit that is operable with a memory, a mass storage device, an input control unit, and an optional display unit. The processing unit can be one of any form of general purpose computer processors that can be used and configured to interface with the components of the printing system and any remote computers and/or users. Additionally, the controller 400 can include well-known support circuits such as power supplies, clocks, cache, input/output circuits and the like. The controller 400 is capable of receiving and sending data to and from the scan module 302, the motive members 304, the paper detector 212, the cutting system 306 and/or the printer 104, shown in FIG. 1. The connection ports 203 allow the controller 400 to communicate with remote computers and/or printers. Thus, the controller 400 can monitor or control the operations of any printer coupled to the connection ports 203. Programs and/or software updates can be sent to the controller 400 if necessary via the connection ports 203. The controller 400 can further indicate to a user when one more components in communication with the controller requires maintenance or attention.

In one aspect of the invention, the controller 400 can operate a paper alignment system 402. The paper alignment system 402 moves print media 300 from an out of alignment position substantially into alignment with a preselected path. The controller 400 may calculate the alignment position, or feed angle, of print media 300 as print media 300 travels through the paper handler 102 in several different ways. In one example, the information set provides the width of print media 300 as it travels across the scan module 302. The width of print media 300 is known; therefore, as print media 300 shifts into and out of alignment the length X of print media 300 moving across the scan module 302 changes. The varying length X across the scan module 302 is processed to determine the alignment of print media 300. The controller 400 then sends instructions to the paper alignment system 402 to move print media substantially back to the preselected travel alignment. Although the controller 400 is described as calculating the feed angle of print media 300 by measuring the varying distance of print media across the scan module 302, it should be appreciated that other suitable methods of calculating the feed angle of print media 300 can be used including, but not limited to, calculating the angle an edge of print media 300 relative to an acceptable preselected angle, calculating the angle of a fold or perforation in print media relative to a preselected angle and calculating the angle of a mark on print media. Once the controller 400 recognizes that the feed angle of print media 300 is out of alignment with the preselected path, the controller 400 can send a correction signal to the paper alignment system 402. The paper alignment system 402 can receive the correction signal and move print media 300 substantially back to the preselected path while print media 300 is being fed through the paper handler 102. This automatic alignment of print media 300 reduces the number of paper jams and the damage to print media 300 as it travels through the printer 104.

In one embodiment of the invention, the paper alignment system 402, as shown, has two independently actuatable motive members 304. The motive members 302 are adapted to engage print media 300 and move a portion of print media 300 at a rate faster or slower that a normal feed rate for print media, in response to the correction signal. By moving the portion of print media 300 the feed angle of print media 300 rotates until it is substantially back to the preselected path. As print media 300 moves back toward the preselected path, the controller 400 can receive the information set reflecting the movement of print media 300. This allows the controller 400 to make real time adjustments to the feed angle of print media 300 as it moves into and out of alignment with the preselected path.

The motive members 304, as shown, comprise a wheel 404 and a motor 406. The motor 406 can receive the correction signal from the controller 400 and operate the wheel 404 at the appropriate speed. The controller 400 can operate the wheel at a speed which is slower, faster or equal to the feed rate of print media 300, depending on the feed angle desired. The motor 406 can couple directly to the wheel 404 which engages print media 300, or can simply be mechanically coupled to the wheel by one or more belts and/or gears. Further, the motor 406 can rotate a belt which engages and moves print media 300. When print media 300 is traveling substantially on the preselected path, the wheels can still engage print media 300 and rotate with print media 300 in a neutral position. Further, the motors 406 can normally operate at the normal feed rate of print media 300 and when the correction signal is sent the motor can adjust the speed of one or more of the wheels 404, until print media 300 is back on the preselected path. Although the one or more motive members 304 are described as being the motor 406 and the wheel 404, it should be appreciated that any suitable system of aligning print media back to the preselected path in response to the correction signal can be used.

The motive members 304, as shown, are located near the edges of media 300 fed through the paper handler 102. In one embodiment, each of the motive members 304 is coupled to the guide member 204. Thus, when the guide member 204 is adjusted for the size of print media 300, the motive members 304 are adjusted to the proper location. The guide members 204, as discussed above, can be manually adjusted to the size of print media or can be automatically adjusted. A sensor, not shown, can be located in each of the guide members 204 in order to detect the edge of print media 300. The sensor can then relay the location of print media to the controller 400 which could actuate one or more actuators, not shown, capable of moving the guide members 204 and/or motive members 304. Further, the controller 400 can adjust the guide members 204 and/or motive members 304 based on information from the information set from the scan module 302. Further, the motive members 304 and the guide members 204 can be separate items capable of independent adjustment either by hand or automatically.

The controller 400 can also calculate various characteristics from the data supplied from the scan module 302. These characteristics can include, but are not limited to the speed at which the paper is traveling through the system, the length of paper, the dimensions and count of individual pages, the positions, dimensions and count of labels, the analysis of any preprinted marks or grids on the paper, the count of print jobs that have traveled through the system. The controller 400 can then send this information to the printer 104 or to the user.

In one aspect of this invention, the paper detector 212, as shown, is an optical scanner. The optical scanner detects the presence and/or absence of print media 300 and relays this information to the controller 400. When print media 300 is not present, the controller 400 can be programmed to maintain the paper handler 102 in an idle position, wherein one or more of the components of the paper handler 102 are at rest. When print media 300 is present, the controller 400 activates the appropriate components of the paper handler 102 in order to feed print media 300 through the paper handler 102. Although the paper detector 212 is described as an optical sensor, it should be appreciated that any suitable system can be used for detecting the presence of print media 300 and turning the components of the paper handler 102 on and off including, but not limited to an on-off switch or button, and/or another type of sensor.

The cutting system 306 can be used when print media 300 is continuous paper. The cutting system 306 cuts print media 300 at the appropriate location on print media 300. In one embodiment, the cutting system 306 has a blade 408, a blade actuator 410 and one or more blade sensors 412. The blade actuator 410 and the blade sensors 412 can be in communication with the controller 400. The blade actuator 410, as shown, has a blade motor 414 and a belt 416 coupled to the blade 408. The controller 400 actuates the blade motor 414 in order to move the belt 416 thereby moving the blade 408 across print media 300. The blade sensors 412 can be one or more optic sensors capable of detecting the presence of the blade 408, further the one or more blade sensors 412 can be any scan module capable of detecting the location of the blade 408.

In operation, the controller 400 sends a cut signal to the blade actuator 410. The blade actuator 410 moves the blade 408 across print media 300 in order to cut print media 300. The normal travel time of the blade 408 is known. If the blade 408 cuts print media 300 normally, the blade 408 simply travels across print media 300 and stops, or returns to the other side of the paper handler 102. If the blade 408 becomes stuck on print media 300, the controller 400 will detect that the blade sensor 412 has not detected the blade 408 within the normal travel time. The controller 400 can then take remediation actions in order to cut print media 300 and/or fix the blade 408. For example, the controller 400 can instruct the blade actuator 410 to move the blade 408 in a reciprocating manner thereby cutting print media 300 with a sawing motion. Further, the controller 400 can send an alert to an operator and/or computer that maintenance is required on the cutting system 306. The alert can be any suitable type of alert including, but not limited to, a light on the paper handler, an audio alert, an email, and/or a text message.

Figure 5:
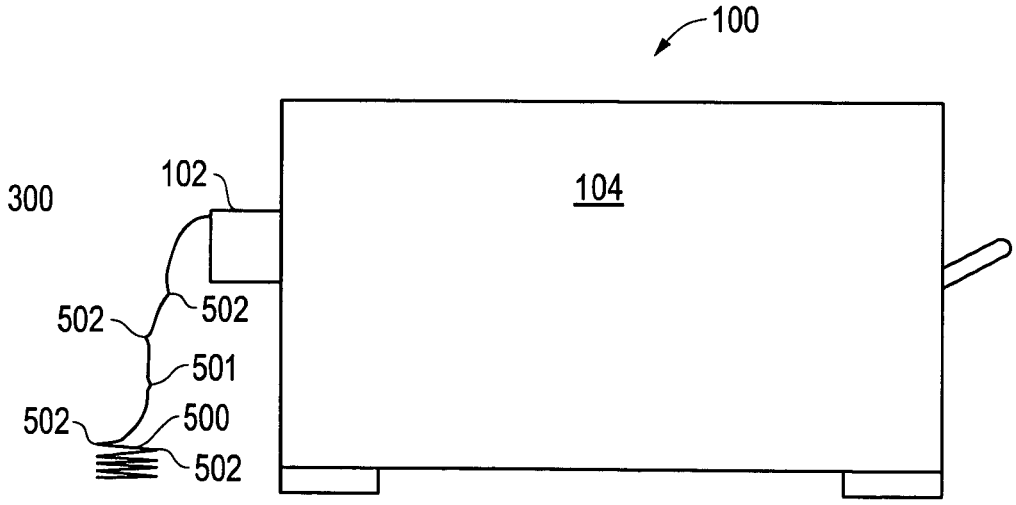
FIG. 5 is a schematic view of a printing system.
Figure 6A:
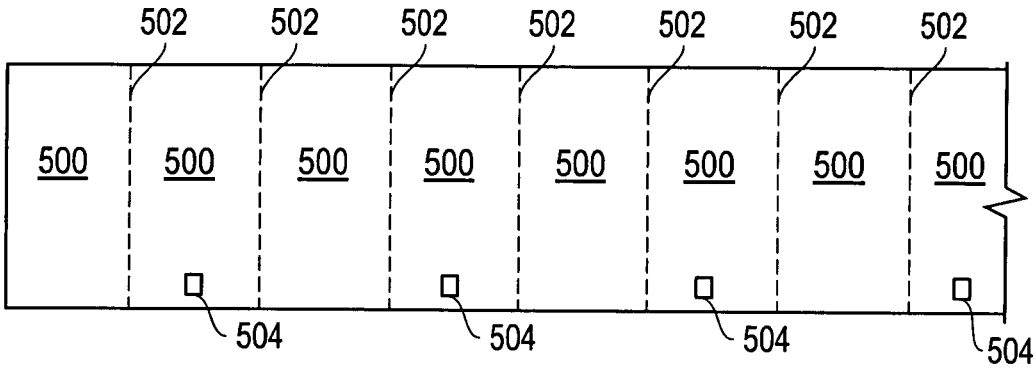
FIG. 6A is a bottom view of continuous feed paper.
Figure 6B:
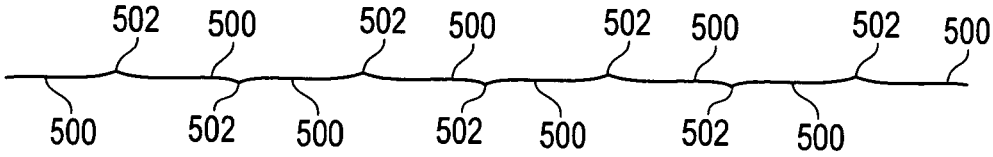
FIG. 6B is a side view of continuous feed paper.

Print media 300 shown in FIGS. 5, 6A and 6B is continuous feed paper, or fan fold paper. The continuous feed paper is fed directly into the paper inlet 200 then through the paper handler 102 and into the printer 104. The continuous feed paper has individual sheets 500 which are separated by a fold 502, and/or perforation, on the paper. The continuous feed paper, or fan fold paper allows the printer 104 to print a long continuous print job on the paper as it is fed through the printing system 100. The fan fold paper allows the paper to be easily stacked both before and after printing. The continuous feed paper can further be the type that comes on a spool, or reel, and is continuously unrolled into the paper handler 102. Continuous feed paper is common for use with graphics that depict data recorded over time or distance, such as used for electrocardiograms and hydrocarbon well data.

When printing on continuous feed paper it can be important to know where the top of form is on the paper. In the past, a series of marks 504 have been placed on the back side of every other individual sheet 500. An optical scanner would then detect the location of the mark and determine the top of form. However, the mark 504 was often located on the second individual sheet 500, thereby wasting the first individual sheet 500. In addition, the inaccuracy of mark placement on the page can lead to imprecise results in determining the top of form. The scan module 302 is capable of detecting the folds 502, and/or perforations, and the direction the folds 502 face. Therefore, the need for a mark 504 on print media 300 is obviated. The location of the folds 502 and the direction of the folds 502 give the controller 400 enough information to determine where the top of form is, what page the printer 104 is currently printing on, where to end the print job and/or where to cut print media 300. The flexibility of the scan module 302 allows the operator to use any suitable indication system to determine the top of form, including but not limited to the marks 504, one or more holes in print media 300, one or more notches in print media 300, the folds, and/or the perforations.

The printer 104 can be any type of printer capable of printing on print media 300. The printer 104 includes a print module, not shown, which prints, marks and/or implants markings on print media 300.

In one embodiment, the printing system 100 is used to print a well log. Print media 300 is fed into the paper inlet 200 of the paper handler 102. The paper detector 212 detects the presence of print media 300 and alerts the controller 400. The controller then initiates the scan module 302 and the motive members 304. The motive members 304 operate at the normal feed rate for print media 300. The motive members 304 engage and feed print media 300 through the paper handler 102. The scan module 302 and controller produce a plurality of information sets about print media 300 as it is fed through the paper handler 102. The controller 400 processes data to determine the top of form. The controller 400 then relays the top of form information to the printer 104, a user and/or the print module. The print job is then initiated in the appropriate location as provided by the controller 400. The well log is printed onto print media 300 until the information set includes information regarding the bottom of form. When the data from the scan module 302 informs the controller 400 that the bottom of form has been reached, the controller 400 sends that information to the printer 104, a user and/or the print module in order to stop the printing operation. Further, the controller 400 can activate the cutting system 306 in order to cut print media 300 at the end of form. In the event the feed angle of print media 300 goes out of an acceptable range from the preselected path, the information set will contain this information. The controller 400 can automatically actuate the paper alignment system 304 in order to adjust the alignment of print media 300 without stopping or slowing the printing operation.

In an alternative embodiment, any or all of the components of the paper handler 102 can be incorporated directly into the printer 104. Therefore, the printer 104 and paper handler 102 may be one stand alone unit.

Figure 6C:
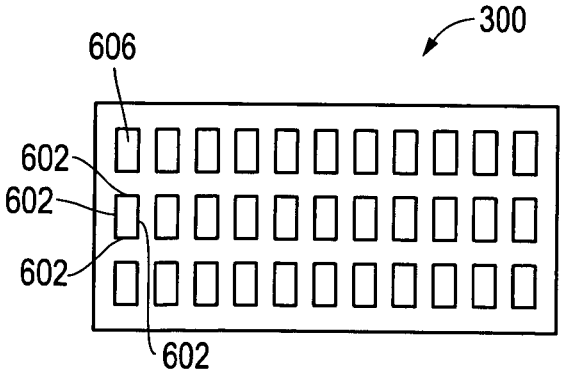
FIG. 6C is a top view of a page of labels.

Print media 300, as shown in FIG. 6C, is a page of labels 600. The labels 600 are fed through the paper handler 102 as described above. The data sent to the controller 400 can include the location of one or more edges 602 of one or more of the labels 600. The controller 400 can relay the exact locations of each of the labels 600, and of the locations of the labels relative to one another to the printer 104, the print module, and/or a user. The printer 104, and/or the user can then ensure that the appropriate label is printed on, and that the printed material is in the proper location on the label 600. This same system can be used to print on irregular shaped labels or stickers.

Further, the paper handler 102 can be used simply as a scanner. The scan module 302 scans print media 300 as it is fed through the paper handler 102. The controller 400 can store and manipulate this data in a manner that makes it electronically reproducible. For example, an existing well log can be fed through the paper handler 102. The controller 400 can then produce an electronic copy of the well log that can be copied, sent or emailed. In an alternative embodiment, the scan module can comprise a computer processor to both scan and process the data to produce an information set.

Preferred methods and apparatus for practicing the present invention have been described. It will be understood and readily apparent to the skilled artisan that many changes and modifications may be made to the above-described embodiments without departing from the spirit and the scope of the present invention. The foregoing is illustrative only and that other embodiments of the integrated processes and apparatus may be employed without departing from the true scope of the invention defined in the following claims.

The invention claimed is:

1. A paper handler for continuous feed paper having one or more folds between each page of the continuous feed paper, comprising:

a paper inlet;

a paper exit;

a scan module comprising one or more sensors to detect and collect raw data regarding one or more characteristics of the continuous feed paper as it is fed through the paper handler, the raw data comprising information on the folds in the continuous feed paper;

a controller configured to receive and process the raw data to determine a feed angle of the continuous feed paper as it travels through the paper handler, determining the feed angle comprising calculating the angle of the one or more folds in the continuous feed paper relative to a preselected angle, wherein the controller is capable of sending a correction signal when it determines the feed angle is out of alignment with the preselected angle;

one or more connectors; and one pair of independently actuatable motive members configured to adjust the alignment of the continuous feed paper, each of the motive members comprising:

a motor for receiving the correction signal from the controller; and a wheel operated by the motor, wherein each of the motive members is coupled to a guide member, wherein the guide members are configured to adjust the location of the two motive members to a position that matches the size of the continuous feed paper, and wherein each of the guide members further comprises an edge for engaging an edge of the continuous feed paper to substantially maintain the continuous feed paper between the guide members as the continuous feed paper travels through the paper handler.

2. The paper handler of claim 1, wherein the motive members are configured to move the continuous feed paper at a rate faster than a normal feed rate.

3. The paper handler of claim 1, wherein the motive are configured to move the continuous feed paper at a rate slower than a normal feed rate.

4. The paper handler of claim 1, wherein the each of the motors is configured adjust the speed of the corresponding wheel until the continuous feed paper is back on a preselected path.

5. The paper handler of claim 1, wherein the scan module further comprises one or more light sources having a length at least as long as the entire width of the paper fed through the paper handler.

6. The paper handler of claim 1, wherein the controller recognizes a top of each page of the continuous feed paper by counting the folds detected by the scan module.

7. The paper handler of claim 1, wherein the continuous feed paper having one or more perforations between every page of the paper.

8. The paper handler of claim 7, wherein the paper further comprises a top of form on the paper which the controller recognizes by counting the perforations detected by the scan module.

9. The paper handler of claim 1, further comprising a paper detector, the paper detector comprising a sensor configured to detect the presence of the paper in the paper handler, and an initiation signal means configured to alert the controller to actuate the scan module.

10. The paper handler of claim 1, further comprising a cutting system comprising: a cutting blade; an actuator configured to move the cutting blade across the width of the paper; and one or more location sensors configured to determine if the blade becomes stuck during a cutting operation.

11. The paper handler of claim 1, the controller producing an information set comprising information regarding the width of the continuous feed paper, the length of the continuous feed paper, the angle the continuous feed paper is traveling relative to a preselected angle, the distance locations on the continuous feed paper are away from the scan module, the presence of shadows on the continuous feed paper, the location of images printed on the continuous feed paper, the location of images formed in the continuous feed paper, the shape of anything on or in the continuous feed paper, the color of anything on or in the continuous feed paper, the location of edges of the continuous feed paper, the location and direction of any folds in the continuous feed paper and the location of perforations in the continuous feed paper.

12. The paper handler of claim 1, wherein each of the guide members further comprises a top surface and a bottom surface for guiding the continuous feed paper through the paper handler.

* * * * *